US009605492B2

(12) United States Patent
Dietz

(10) Patent No.: US 9,605,492 B2
(45) Date of Patent: Mar. 28, 2017

(54) QUICK CONNECT FOR WELLBORE TUBULARS

(71) Applicant: Halliburton Energy Services, Inc., Houston, TX (US)

(72) Inventor: Wesley Paul Dietz, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 293 days.

(21) Appl. No.: 14/378,771

(22) PCT Filed: Oct. 7, 2013

(86) PCT No.: PCT/US2013/063711

§ 371 (c)(1),
(2) Date: Aug. 14, 2014

(87) PCT Pub. No.: WO2015/053742

PCT Pub. Date: Apr. 16, 2015

(65) Prior Publication Data

US 2016/0230478 A1 Aug. 11, 2016

(51) Int. Cl.
*E21B 17/04* (2006.01)
*E21B 17/02* (2006.01)
(Continued)

(52) U.S. Cl.
CPC ..... *E21B 17/043* (2013.01); *E21B 17/02* (2013.01); *E21B 17/04* (2013.01); *E21B 43/10* (2013.01)

(58) Field of Classification Search
CPC ..... E21B 17/02; E21B 17/04; E21B 17/046; F16L 13/141; F16L 37/1215; F16L 37/08;
(Continued)

(56) References Cited

U.S. PATENT DOCUMENTS 2,113,508 A * 4/1938 Guinn ..... E21B 17/046 403/320
2,314,867 A * 3/1943 Boynton ..... E21B 17/046 285/111
(Continued)

FOREIGN PATENT DOCUMENTS

WO 2015053742 A1 4/2015

OTHER PUBLICATIONS

International Search Report and Written Opinion for PCT/US2013/063711 dated Jun. 25, 2014.
(Continued)

*Primary Examiner* — Jennifer H Gay
(74) *Attorney, Agent, or Firm* — McDermott Will & Emery LLP

(57) ABSTRACT

Disclosed is a coupling assembly that includes an upper adapter having an upper adapter body providing a latching collet and a torque collet, the torque collet including a plurality of axially-extending torque members and a corresponding torque lug defined in each axially-extending torque member, and a lower adapter having a lower adapter body configured to receive the upper adapter body and providing a series of latch mating threads defined on an inner surface of the lower adapter body and a torque collet profile, the latch mating threads being configured to matingly engage the latching collet and the torque collet profile including one or more longitudinal slots defined in the lower adapter body and configured to receive the torque lugs therein, wherein, when the torque lugs are received into the longitudinal slots, torque may be applied between the upper and lower adapters in at least one angular direction.

20 Claims, 5 Drawing Sheets

(51) Int. Cl.
*E21B 43/10* (2006.01)
*E21B 17/043* (2006.01)

(58) Field of Classification Search
CPC ... F16L 37/084; F16L 37/092; F16L 37/0925; Y10T 403/7026; Y10T 403/7035
USPC ..... 166/242.6, 380; 285/34, 322, 913, 330
See application file for complete search history.

(56) References Cited

U.S. PATENT DOCUMENTS 3,037,797 A * 6/1962 Brown ..... E21B 17/046 166/181
3,494,418 A * 2/1970 Young ..... E21B 23/006 166/123
3,918,747 A 11/1975 Putch
4,411,455 A * 10/1983 Schnatzmeyer ..... F16L 37/084 166/237
4,635,728 A 1/1987 Harrington
5,207,274 A 5/1993 Streich et al.
5,403,043 A * 4/1995 Smet ..... F16L 37/2445 285/148.21
5,607,250 A * 3/1997 Tatterson ..... E21B 17/046 166/377
5,848,646 A * 12/1998 Huber ..... E21B 17/046 166/297
6,168,213 B1 * 1/2001 Muller ..... E21B 17/04 166/242.6
6,460,900 B1 * 10/2002 Bakke ..... E21B 17/046 285/330
7,798,213 B2 9/2010 Harvey et al.
8,496,064 B2 * 7/2013 Du ..... E21B 17/06 166/242.1
8,505,638 B2 * 8/2013 Ezell ..... E21B 23/00 166/242.7
2005/0155770 A1 * 7/2005 Parrott ..... E21B 43/11 166/380
2009/0056947 A1 3/2009 Du et al.
2010/0116487 A1 5/2010 Moyes
2010/0126776 A1 * 5/2010 Trevino ..... E21B 7/20 175/61
2011/0168406 A1 * 7/2011 Du ..... E21B 19/16 166/380
2011/0180273 A1 * 7/2011 Hughes ..... E21B 17/04 166/380
2011/0315400 A1 12/2011 Zweifel
2012/0168148 A1 * 7/2012 Avant ..... E21B 23/02 166/209
2012/0234560 A1 * 9/2012 Ezell ..... E21B 23/00 166/382
2012/0298376 A1 11/2012 Twardowski
2013/0087324 A1 4/2013 Moeller et al.
2013/0161027 A1 6/2013 Inglis et al.
2015/0240571 A1 * 8/2015 Bowles ..... E21B 17/04 285/351

OTHER PUBLICATIONS

Examination Report received in corresponding Australian Application No. 2013402479, dated Aug. 8, 2016.

* cited by examiner

QUICK CONNECT FOR WELLBORE TUBULARS

BACKGROUND

The present disclosure describes coupling assemblies used in the oil and gas industry and, more particularly, a coupling assembly that operatively couples drill pipe to casing and is able to withstand both axial and torsional loads.

During the drilling and completion of hydrocarbon-bearing wells, casing is typically inserted into the wellbore and used to line the walls of the wellbore. The casing may then be advanced to its final location within the wellbore using, for example, drill pipe or other types of wellbore tubulars extended from a surface location. In some cases, the casing and the drill pipe are built on the rig floor simultaneously such that a dual string is lowered into the wellbore, where the drill pipe is built and arranged within the casing string. However, it is difficult to simultaneously make-up nested drill pipe connections and casing connections as the dual string is run into the wellbore.

To avoid having to build both casing and the drill pipe simultaneously, the casing is often built and introduced into the wellbore first and then hung off within the wellbore at a predetermined location. The drill pipe is then subsequently built and introduced into the wellbore and extended until being able to connect to the casing at a casing running tool associated with the casing. Coupling the drill pipe to the casing can be a difficult undertaking and often requires predetermined amounts of torque and/or pressure.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure describes coupling assemblies used in the oil and gas industry and, more particularly, a coupling assembly that operatively couples drill pipe to casing and is able to withstand both axial and torsional loads.

Disclosed is a coupling assembly that may be used to couple drill pipe to casing string. The coupling assembly may have an upper adapter and a lower adapter, where the upper adapter is configured to be stabbed or otherwise inserted into the lower adapter to complete a connection. Once properly coupled, the coupling assembly may be capable of handling axial loads (tension and compression), torque loads (twisting or rotating the combination of the drill pipe and the casing), and hydraulic pressure. The disclosed embodiments may prove advantageous in application where dual strings (casing with drill pipe inside) are run from a surface location. According to the present disclosure, a full casing string may be assembled and lowered into the well and hung-off, and the drill pipe may be assembled and lowered inside the casing string until the coupling assembly makes its connection. Once the coupling assembly is properly coupled, the drill pipe may advance the casing into the wellbore.

Figure 1:
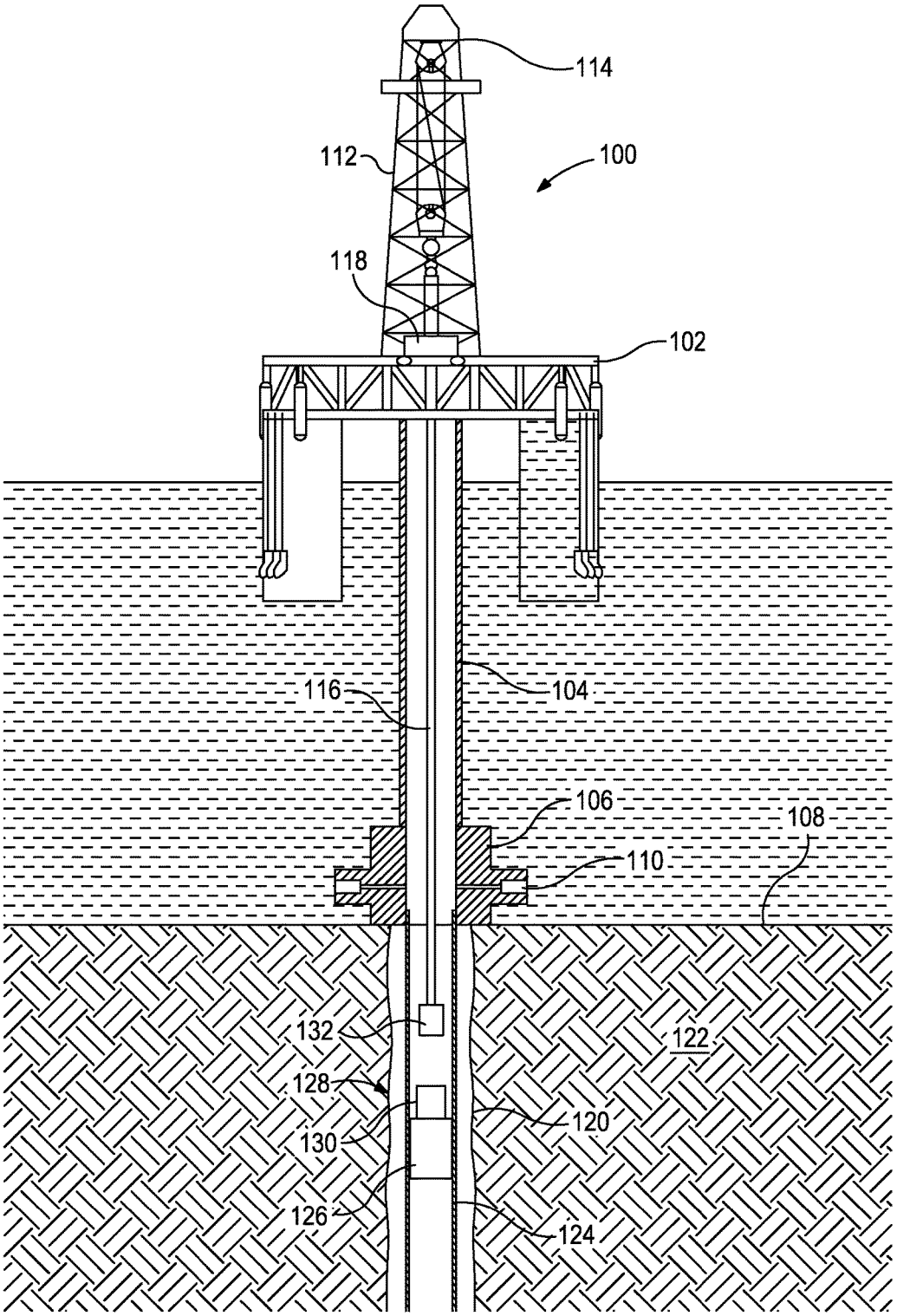
FIG. 1 depicts an offshore oil and gas platform that may implement one or more principles of the present disclosure, according to one or more embodiments.

Referring to FIG. 1, illustrated is an offshore oil and gas platform 100 that may implement one or more principles of the present disclosure, according to one or more embodiments. Even though FIG. 1 depicts an offshore oil and gas platform 100, it will be appreciated by those skilled in the art that the presently disclosed principles and embodiments are equally well suited for use in or on other types of oil and gas rigs, such as land-based oil and gas rigs or rigs arranged in any other geographical location. Moreover, the presently disclosed principles and embodiments may prove useful in any application where a tool needs to be quickly connected to a wellbore tubular downhole.

As illustrated, the platform 100 may be a semi-submersible platform having a deck 102 and a subsea conduit or riser 104 extending from the deck 102 to a subsea wellhead 106 arranged on the sea floor 108. The subsea wellhead 106 may include one or more blowout preventers 110. The platform 100 has a derrick 112 and a hoisting apparatus 114 for raising and lowering drill pipe or a drill string 116. A rotary table and kelly 118 are also arranged on the deck 102 to help facilitate the make-up and lowering of the drill string 116. The term "drill string," as used herein, may refer to one or more types of connected lengths of wellbore tubulars as known in the art, and may include, but is not limited to, drill pipe, landing string, or production tubing.

A wellbore 120 extends below the subsea wellhead 106 and has been drilled through various earth strata 122. Casing or a string of casing 124 may be arranged within the wellbore 120 and otherwise removably coupled (e.g., hung off) at or adjacent the subsea wellhead 106. The term "casing" is used herein to designate a tubular string commonly used to line wellbores. Casing may actually be of the type known to those skilled in the art as "liner" and may be made of any material, such as steel or composite materials and may be segmented or continuous.

In the illustrated embodiment, a casing running tool 126 may be coupled or otherwise attached to the interior of the casing string 124. The casing running tool 126 may allow the drill string 116 to be attached to the casing string 124 so that the drill string 116 may be used to advance the casing string 124 further downhole within the wellbore 120. To accomplish this, a coupling assembly 128 may be employed, where the coupling assembly 128 includes a lower adapter 130 and an upper adapter 132. As illustrated, the lower adapter 130 may be associated with and otherwise coupled to the casing running tool 126. In some embodiments, for example, the lower adapter 130 may be threaded to the casing running tool 126. In other embodiments, the lower adapter 130 may be mechanically fastened to the casing running tool 126, such as through the use of one or more mechanical fasteners (e.g., bolts, screws, pins, snap rings, etc.) or one or more lugs or keys. In yet other embodiments, a combination of threading and mechanical fasteners may be used to couple the lower adapter 130 to the casing running tool 126. In at least one embodiment, the lower adapter 130 may be preinstalled to the casing running tool 126 prior to deployment downhole.

The upper running tool 132 may be coupled or otherwise attached to the distal end of the drill string 116 and extended downhole from the platform 100. Each of the lower and upper adapters 130, 132 may be tubular in shape and include an axial bore therethrough. The upper adapter 132 may exhibit an outer diameter that is smaller than the inner diameter of the lower adapter 130 such that the upper adapter 132 may be inserted at least partially into the lower adapter 130 to couple the two adapters 130, 132 together. Accordingly, the upper adapter 132 may be characterized as a stinger, and the lower adapter 130 may be characterized as a socket configured to receive and secure the stinger therein.

Once the lower and upper adapters 130, 132 are properly coupled, the drill string 116 is then secured to and otherwise removably coupled to the casing string 124. Moreover, as described in more detail below, once the lower and upper adapters 130, 132 are properly coupled, the coupling assembly 128 may be capable of handling axial loads (tension and compression), torque loads (twisting or rotating the combination of the drill string 116 and the casing string 124), and hydraulic pressure. At least one advantage of the coupling assembly 128, is that the drill string 116 may be coupled to the casing string 124 by simply stabbing the upper adapter 132 into the lower adapter 130.

Figure 2:
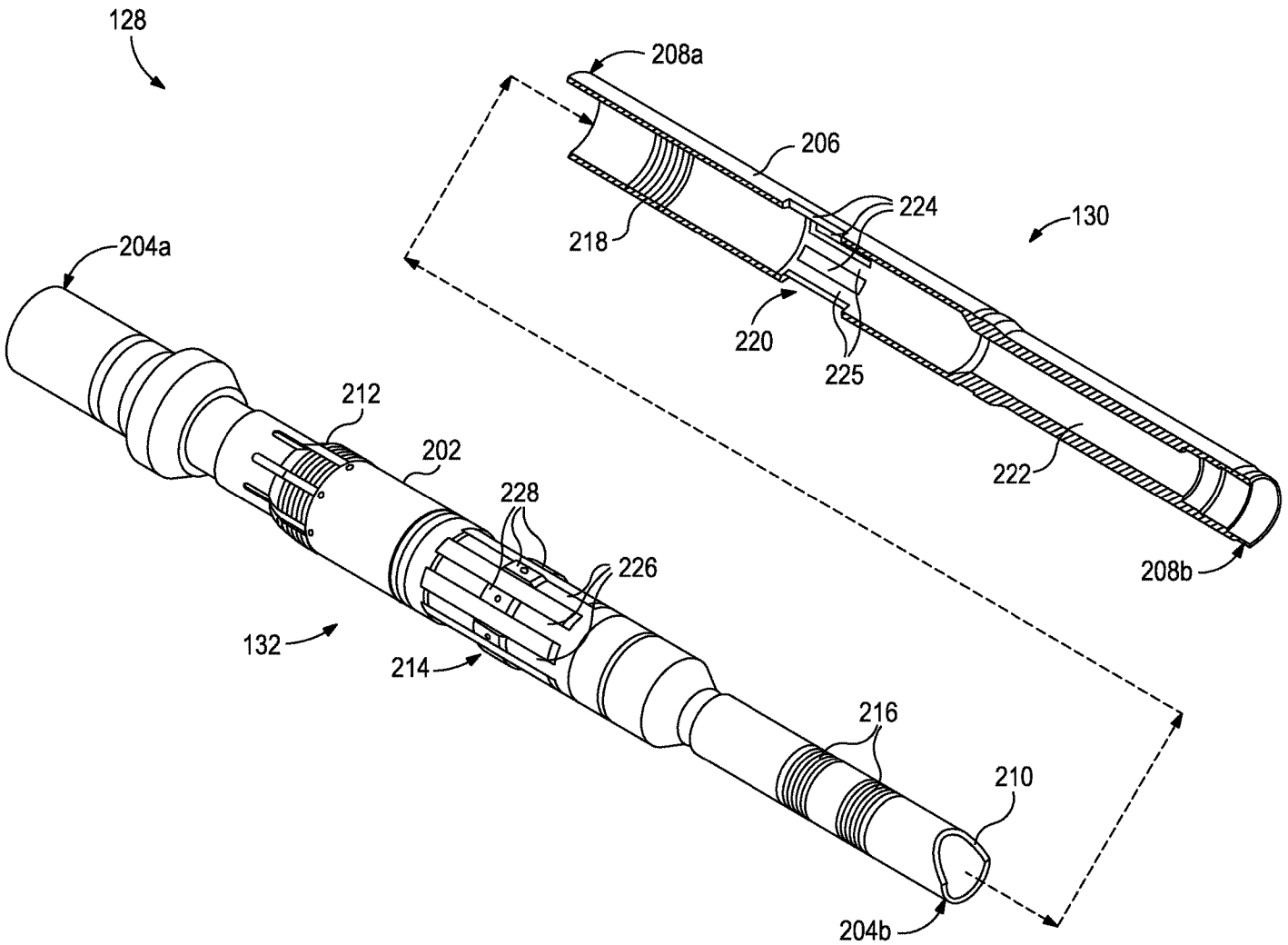
FIG. 2 illustrates an exploded isometric view of the coupling assembly of FIG. 1, according to one or more embodiments.

Referring now to FIG. 2, with continued reference to FIG. 1, illustrated is an exploded isometric view of the coupling assembly 128, according to one or more embodiments. More particularly, illustrated is an isometric view of the upper adapter 132 and an isometric, partial cross-sectional view of the lower adapter 130. The upper adapter 132 may include an elongate body 202 having a first end 204*a* and a second end 204*b*, and the lower adapter 132 may also include an elongate body 206 having a first end 208*a* and a second end 208*b*. The first end 204*a* of the upper adapter 132 may encompass a drill pipe connection configured to be coupled to the drill string 116 (FIG. 1). The second end 204*b* of the upper adapter 132 may be configured to be extended through and otherwise inserted into the first end 208*a* of the lower adapter 130. In some embodiments, the second end 204*b* of the upper adapter 132 may include or provide a mule shoe 210 or another type of chamfered end surface configured to direct and/or orient the second end 204*b* of the upper adapter 132 into the first end 208*a* of the lower adapter 130. The second end 208*b* of the lower adapter 130 may be configured such that it can couple the lower adapter 130 to the casing running tool 126 (FIG. 1), as generally described above.

The upper adapter 132 may include or otherwise provide a latching collet 212, a torque collet 214 and one or more packing seals 216. In the illustrated embodiment, the latching collet 212 is depicted as being arranged axially above the torque collet 214 on the body 202. In other embodiments, however, the relative positions of the latching collet 212 and the torque collet 214 may be reversed, with the latching collet 212 being arranged axially below the torque collet 214 on the body 202, without departing from the scope of the disclosure. The one or more packing seals 216 may be any type of sealing device including, but not limited to, O-rings, v-rings, or other appropriate seal configurations (e.g., seals that are round, v-shaped, u-shaped, square, oval, t-shaped, etc.), as generally known to those skilled in the art.

The lower adapter 130 may include or otherwise provide a series of latch mating threads 218, a torque collet profile 220, and a seal bore 222. The latch mating threads 218 may be defined on the interior surface of the body 206 and, as discussed in more detail below, may be configured to mate with the latching collet 212 of the upper adapter 132. The seal bore 222 may be configured to mate with the packing seals 216 of the upper adapter 132 and thereby provide a fluid-tight seal within the lower adapter 130. More particularly, the inner diameter of the seal bore 222 may be sized to receive the packing seals 216 and thereby provide a generally sealed interface therebetween.

The torque collet profile 220 may include one or more longitudinal slots 224 defined in the body 206 and separated by corresponding longitudinal slats 225. The longitudinal slots 224 may be configured to mate with the torque collet 214. More particularly, the torque collet 214 may include a plurality of axially-extending torque members 226, where each torque member 228 defines or otherwise provides a corresponding torque lug 228. Each torque lug 228 may be configured to mate with and/or extend into a corresponding slot 224 of the torque collet profile 220, and thereby allow torque to be transmitted through the coupling assembly 128. In some embodiments, the slots 224 may be defined on the interior surface of the body 206 but not extend fully through the body 206. In other embodiments, however, the slots 224 may extend entirely through the body 206, from the outer radial surface to the inner radial surface thereof, as depicted.

Figure 3A:
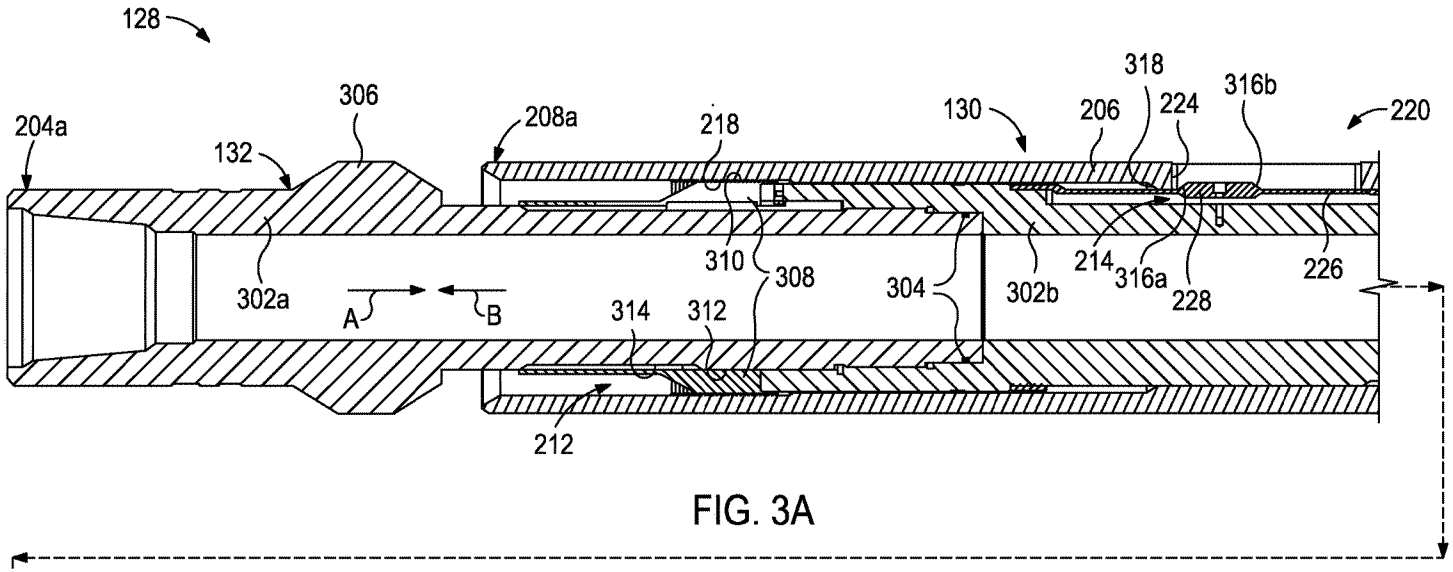
FIGS. 3A and 3B illustrate progressive cross-sectional side views of the coupling assembly of FIG. 1 in a first configuration, according to one or more embodiments.
Figure 3B:
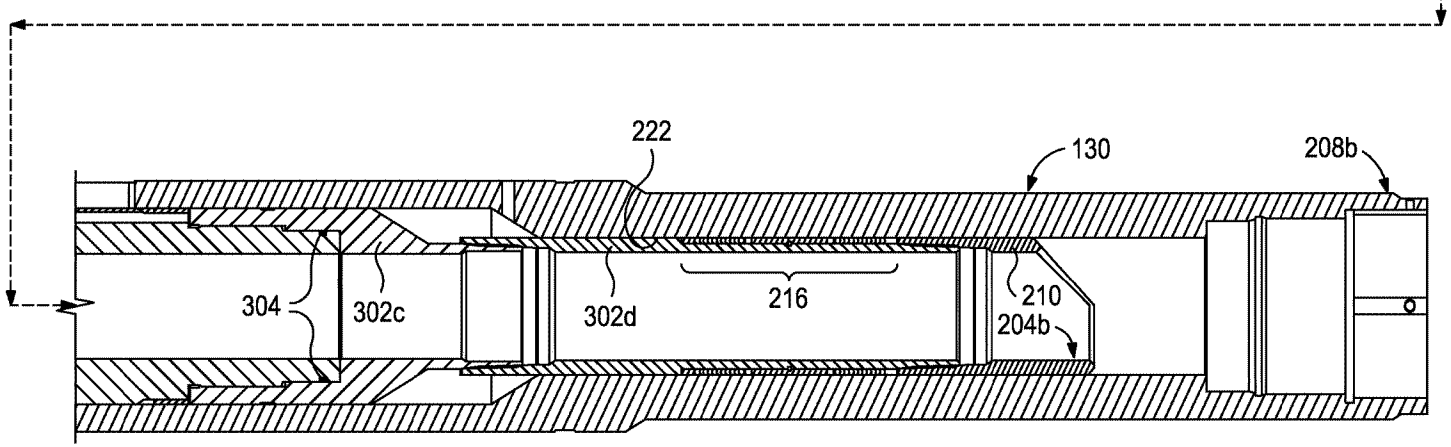

Referring now to FIGS. 3A and 3B, with continued reference to FIGS. 1 and 2, illustrated are progressive cross-sectional side views of the coupling assembly 128, according to one or more embodiments. Like numerals used in FIGS. 3A-3B and FIG. 2 refer to like components or elements that will not be described again in detail. FIG. 3A depicts an upper portion of the coupling assembly 128, and FIG. 3B is a continuation of FIG. 3A, and otherwise depicts a lower portion of the coupling assembly 128. As depicted in FIGS. 3A and 3B, the coupling assembly 128 is in a first configuration, where the upper adapter 132 is at least partially inserted or otherwise extended into the lower adapter 130. As will be discussed in greater detail below, the first configuration may also be characterized as a tensile configuration for the coupling assembly 128, where the upper adapter 132 is being pulled back toward the surface (i.e., to the left in FIGS. 3A and 3B) and therefore separates a short distance from the lower adapter 130.

As illustrated, the body 202 (FIG. 2) of the upper adapter 132 may generally include an upper mandrel 302*a*, an intermediate mandrel 302*b*, and a crossover 302*c* (FIG. 3B). The upper mandrel 302*a* may be arranged at the first end 204*a* of the upper adapter 132, and the intermediate mandrel 302*b* may axially interpose the upper mandrel 302*a* and the crossover 302*c*. The upper mandrel 302*a* may be configured to couple the upper adapter 132 to the drill string 116 (FIG. 1), as discussed above. The intermediate mandrel 302*b* may be threaded or mechanically fastened (or both) to the upper mandrel 302*a* at one end, and threaded or mechanically fastened (or both) to the crossover 302*c* at its opposing axial end. In some embodiments, one or more sealing elements 304 may be used to seal the respective interfaces between the upper and intermediate mandrels 302*a,b* and the intermediate mandrel 302*b* and the crossover 302*c*. In some embodiments, the sealing elements 304 may be O-rings, but may equally include or otherwise encompass one or more v-rings or other appropriately-shaped seal configurations (e.g., round, u-shaped, square, oval, t-shaped, etc.).

At its distal end, the crossover 302*c* may be coupled to a seal assembly 302*d*, which carries or otherwise provides the packing seals 216 described above. The crossover 302*c* may be threaded or mechanically fastened (or both) to the seal assembly 302*d*, and the seal assembly 302*d* may be coupled to the mule shoe 210 at its distal end. Moreover, the interface between the crossover 302*c* and the seal assembly 302*d* may be a sealed interface, either through a threaded sealing engagement or through the use of one or more sealing elements.

Figures 4A, 4B:
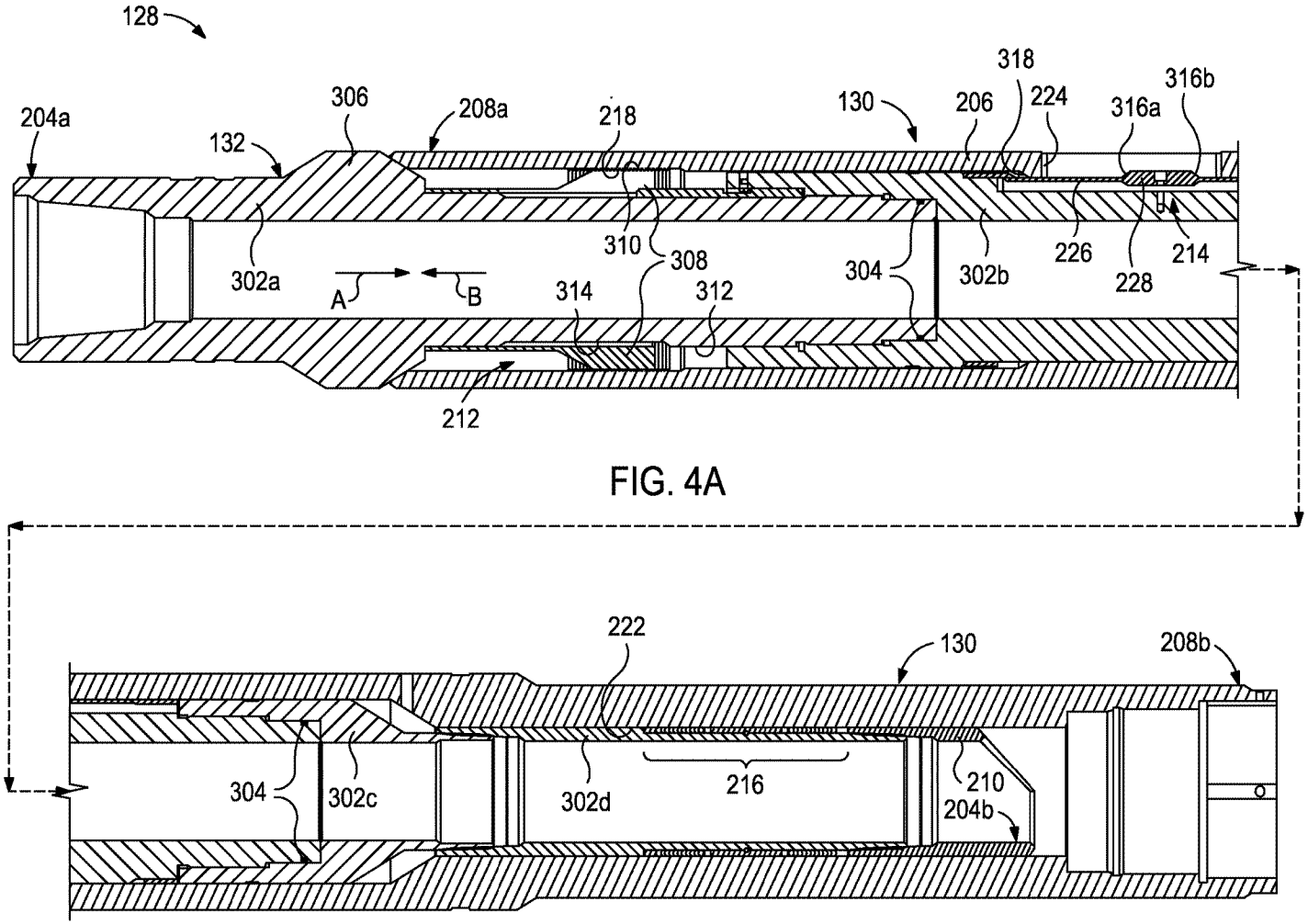
FIGS. 4A and 4B illustrate progressive cross-sectional side views of the coupling assembly of FIG. 1 in a second configuration, according to one or more embodiments.

At or near the first end 204*a* of the body 202 (FIG. 2) the upper mandrel 302*a* defines and/or provides a radial protrusion 306. The radial protrusion 306 may serve as a no-go for the first end 208*a* of the lower adapter 130. More specifically, the radial protrusion 306 may exhibit a diameter greater than or equal to the diameter of the first end 208*a* of the lower adapter 130. As a result, the upper adapter 132 may be inserted into the lower adapter 130 in the direction A until being prevented from further axial advancement when the first end 208*a* of the lower adapter 130 engages the radial protrusion 306. Such a scenario is shown in FIG. 4A, and will be discussed below.

The latching collet 212 may be defined by or provided on the upper mandrel 302*a*. As illustrated, the latching collet 212 may include a plurality of axially extending fingers 308 (two shown). Each axially extending finger 308 may define a series of latching threads 310 on an outer surface thereof. As the upper adapter 132 is advanced into the lower adapter 130 in the direction A, the latching threads 308 may be configured to interact with or otherwise engage the latch mating threads 218 defined on the inner surface of the body 206 of the lower adapter 130. Upon engaging the latch mating threads 218, the axially extending fingers 308 may cause the latching collet 212 to axially move in the direction B (opposite the direction A) until engaging the radial protrusion 306.

The latching collet 212 may further define a radial shoulder 312 and a radial groove 314 axially offset from the radial shoulder 312. When the coupling assembly 128 is in the first configuration, as shown in FIG. 3A, the axially extending fingers 308 are radially supported by and otherwise biased against the radial shoulder 312. When the latching collet 212 is moved in the direction B until engaging the radial protrusion 306, however, the axially extending fingers 308 may be moved out of radial engagement with the radial shoulder 312 and otherwise radially offset from the radial groove 314. This configuration is shown in FIG. 4A described below. Once radially offset from the radial groove 314, the axially extending fingers 308 may be able to flex inwards such that the latching threads 310 may ratchet against the opposing latch mating threads 218 as the upper adapter 132 continues to be advanced into the lower adapter 130 in the direction A.

The torque collet 214 may be defined or otherwise provided on the intermediate mandrel 302*b*. As depicted, the axially extending torque members 226 (one shown) may be supported at each end and therefore able to flex radially in the middle portions thereof. Moreover, since the axially extending torque members 226 are supported at each end, they are able to transmit torque via the torque lugs 228. In some embodiments, the torque lugs 228 (one shown) may be beveled on one or both axial ends 316*a* and 316*b* in order to help facilitate entrance into and exit from the slots 224 provided by the torque collet profile 220. More particularly, and in conjunction with the ability of each torque member 226 to flex radially, the beveled lower axial end 316*b* may help the torque lug 228 flex radially inward and enter a corresponding slot 224 when the upper adapter 132 is being inserted into the lower adapter 130 in the direction A. Similarly, the beveled upper axial end 316*a* may help the torque lugs 228 flex radially inward and so that each can exit the slots 224 when it is desired to separate the upper adapter 132 from the lower adapter 130 in the direction B.

Referring additionally now to FIGS. 4A and 4B, with continued reference to FIGS. 3A and 3B, exemplary operation of the coupling assembly 128 will now be described. FIGS. 4A and 4B depict progressive cross-sectional side views of the coupling assembly 128 in a second or compression configuration, according to one or more embodiments. Similar to FIGS. 3A and 3B, FIG. 4A depicts an upper portion of the coupling assembly 128, and FIG. 4B is a continuation of FIG. 4A and otherwise depicts a lower portion of the coupling assembly 128. Like numerals used in prior figures will again correspond to like components or elements not described again.

In order to couple the upper adapter 132 to the lower adapter 130, the upper adapter 132 may be axially extended or otherwise stabbed into the lower adapter 130 in the direction A. The chamfered edge or surface of the mule shoe 210 may direct and otherwise properly orient the second end 204*b* of the upper adapter 132 into the first end 208*a* of the lower adapter 130. The seal assembly 302*d* may eventually enter the seal bore 222 and the packing seals 216 may provide a sealed interface against the inner wall of the seal bore 222. The sealed interface may prove advantageous in conveying hydraulic pressure through the coupling assembly 128. For instance, tools located downhole from the coupling assembly 128 (e.g., the casing running tool 126 of FIG. 1) may be actuated using fluid pressure conveyed through the coupling assembly 128.

The upper adapter 132 may be advanced in the direction A until the latching threads 310 of the axially extending fingers 308 engage or otherwise interact with the latch mating threads 218 defined on the inner surface of the body 206 of the lower adapter 130. As described above, interaction between the latching threads 310 and the latch mating threads 218 causes the latching collet 212 to move in the direction B until engaging the radial protrusion 306, thereby also moving the axially extending fingers 308 out of radial engagement with the radial shoulder 312, and instead becoming radially offset from the radial groove 314. Once arranged radially from the radial groove 314, as depicted in FIG. 4A, the axially extending fingers 308 may be able to flex inward with respect to the inner surface of the body 206 of the lower adapter 130, such that the latching threads 310 are able to ratchet against and otherwise axially traverse the latch mating threads 218.

As the upper adapter 132 is advanced in the direction A, the torque collet 214 may eventually interact with the torque collet profile 220. More particularly, as the upper adapter 132 is advanced in the direction A, the torque lugs 228 defined on each axially extending torque member 226 may engage a beveled surface 318 defined on the interior of the body 206 of the lower adapter 130. The beveled lower axial ends 316*b* of each torque lug 228 may slidingly engage the beveled surface 318 and cause the torque members 226 to flex radially inward. In some embodiments, further advancement of the upper adapter 132 in the direction A may allow the torque lugs 228 to extend into a corresponding slot 224 defined in the torque collet profile 220.

In other embodiments, however, the torque lugs 228 may not necessarily be angularly aligned with the slots 224, and therefore may not extend therein. Rather, the torque members 226 may remain flexed inward as the torque lugs 228 are radially biased against the longitudinal slats 225 (FIG. 2) provided between each pair of adjacent slots 224. In such embodiments, the upper adapter 132 may nonetheless advance in the direction A, but the torque lugs 228 will not be positioned to provide torque to the coupling assembly 128. In order to align the torque lugs 228 with the slots 224, and thereby enable torque transmission through the coupling assembly 128, the upper adapter 132 may be angularly rotated from the surface (e.g., from the platform 100 of FIG. 1) until the torque lugs 228 locate the corresponding slots 224 and flex outward into a mating relationship therewith.

As depicted in FIG. 4A, the upper adapter 132 may be advanced in the direction A until the first end 208*a* of the lower adapter 130 engages the radial protrusion 306 defined on the upper mandrel 302*a*. Once the first end 208*a* engages the radial protrusion 306, the coupling assembly 128 may then be able to transmit axial force from the drill string 116 (FIG. 1) to the casing 124 (FIG. 1). More particularly, and with reference again to FIG. 1, the drill string 116 may then be able to advance the casing 124 further within the wellbore 120.

Moreover, with the torque lugs 228 located or otherwise seated in the corresponding slots 224 of the torque collet profile 220, the drill string 116 may be able to transmit torsion to the casing 124 via the coupling assembly 128 in at least one angular direction. As will be appreciated, the ability to apply torque to the casing 124 through the coupling assembly 128 may prove advantageous for several reasons. For instance, it may be required to angularly rotate the casing 124 in order to orient a pre-milled window (not shown) provided on the casing 124 to a predetermined angular orientation within the wellbore 120. Moreover, it may be required to angularly rotate the casing 124 in order to drive the casing through downhole obstructions, such as debris or radial obstructions present within the wellbore 120.

In yet other embodiments, it may be required to angularly rotate the coupling assembly 128 in order to disassemble or otherwise detach the casing running tool 126 from the casing 124. For instance, rotating the casing running tool 126 in one angular direction (i.e., left hand rotation) may be configured to shear one or more shear screws or other shearable devices associated with the casing running tool 126, and thereby activate a secondary release mechanism for the casing running tool 126.

Advantageously, the coupling assembly 128 may be properly assembled by simply stabbing the upper adapter 132 into the lower adapter 130, as generally described above. Until torque is needed at the end of the casing 124, or to detach the casing running tool 126 (or another wellbore tool), the upper adapter 132 need not be rotated with respect to the lower adapter 130. Rather, an axial load may be applied through the coupling assembly 128 once the first end 208*a* of the lower adapter 130 engages the radial protrusion 306 of the upper mandrel 302*a*. Once torque is needed, however, the upper adapter 132 may be slightly rotated in one angular direction (e.g., right hand rotation) until the torque lugs 228 properly locate the corresponding slots 224 of the torque collet profile 220. Once properly located in the corresponding slots 224, the torque lugs 228 and associated longitudinal torque members 226 may allow torque transmission through the coupling assembly 128 in either angular direction.

Referring again to FIG. 3A, the coupling assembly 128 is shown in the first configuration, which can be characterized as the tensile configuration. More specifically, not only is the coupling assembly 128 able to transmit compression between the lower and upper adapters 130, 132, but the coupling assembly 128 may also be configured to withstand tensile loads between the lower and upper adapters 130, 132. Upon pulling the drill string 116 (FIG. 1) back toward the surface in the direction B, the latching collet 212 may again be moved in the direction A with respect to the radial protrusion 306. As a result, the axially extending fingers 308 may translate into radial engagement once again with the radial shoulder 312, thereby forcing the latching threads 310 into gripping or threaded engagement with the latch mating threads 218 defined on the inner surface of the body 206 of the lower adapter 130. The resulting engagement between the latching threads 310 and the latch mating threads 218 may allow tension to be transmitted across the coupling assembly 128.

Moreover, the resulting engagement between the latching threads 310 and the latch mating threads 218 may provide a threaded engagement between the latching collet 212 and the body 206 of the lower adapter 130. Accordingly, rotating the upper adapter 132 in a predetermined angular direction (e.g., left hand rotation) with respect to the lower adapter 130 may result in the two adapters 130, 132 being unthreaded from each other. Such a threaded engagement may prove useful in disassembling the coupling assembly 128, such as when the coupling assembly 128 is returned to a surface location and the adapters 130, 132 are able to be unthreaded from each other.

Figure 5:
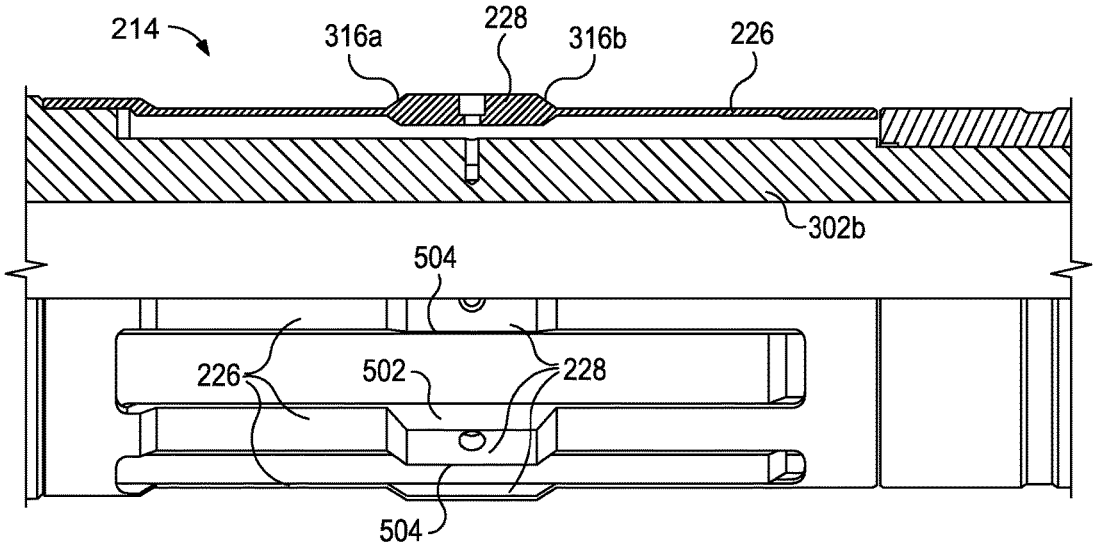
FIG. 5 illustrates an enlarged partial cross-sectional side view of the torque collet of FIG. 2, according to one or more embodiments

Referring now to FIG. 5, with continued reference to FIGS. 3A-3B and FIGS. 4A-4B, illustrated is an enlarged partial cross-sectional side view of the torque collet 214, according to one or more embodiments. In one or more embodiments, the torque lugs 228 may be beveled or otherwise chamfered on one longitudinal side or edge 502. The beveled longitudinal edge 502 may prove advantageous in enabling the torque collet 212 to freely ratchet in one angular direction. More particularly, with the beveled longitudinal edge 502, the torque collet 212 may be able to be freely rotated in the direction of the longitudinal edges 502 without transmitting torque. The beveled longitudinal edges 502 will engage the longitudinal slats 225 (FIG. 2), and thereby force the torque lugs 228 radially inward and beneath the longitudinal slats 225. As a result, the torque collet 214 may be configured to radially collapse as it is rotated in one angular direction, thereby not transmitting torque in that direction. Since the opposing longitudinal edges 504 are not chamfered or otherwise beveled, torque may be transmitted through the torque collet 214 by rotating in the opposite angular direction.

As will be appreciated, such an embodiment may prove advantageous in applications where a tool (not shown) arranged downhole from the coupling assembly 128 is required to transmit torque in one direction, but is released (i.e., unthreaded) from the advancing drill string 116 by rotating in the opposite direction. With the torque collet 214 being configured to ratchet in one direction, the downhole tool will not be released by inadvertently rotating the drill string 116 in the direction that would unthread the downhole tool. Rather, the beveled longitudinal edges 502 may force the torque lugs 228 to flex radially inward and beneath the longitudinal slats 225, thereby allowing the torque collet 214 to ratchet in one direction without transmitting torque downhole. As will be appreciated, the beveled longitudinal edges 502 may be defined on either longitudinal edge 502, 504 of the torque lugs 228, thereby providing a ratcheting effect for the torque collet 214 in either angular direction as desired.

Embodiments disclosed herein include:

A. A coupling assembly that may include an upper adapter having an upper adapter body that provides a latching collet and a torque collet axially spaced from the latching collet, the torque collet including a plurality of axially-extending torque members and a corresponding torque lug defined in each axially-extending torque member, and a lower adapter having a lower adapter body configured to receive the upper adapter body and providing a series of latch mating threads defined on an inner surface of the lower adapter body and a torque collet profile, the latch mating threads being configured to matingly engage the latching collet and the torque collet profile including one or more longitudinal slots defined in the lower adapter body and configured to receive the torque lugs therein. When the upper adapter is received within the lower adapter, compression and tension loads may be applied between the upper and lower adapters. When the torque lugs are received into the longitudinal slots, torque may be applied between the upper and lower adapters in at least one angular direction.

B. A method that may include advancing an upper adapter at least partially into a lower adapter, the upper adapter having a latching collet providing a plurality of axially extending fingers and a torque collet axially spaced from the latching collet, and the lower adapter providing a torque collet profile that defines a plurality of longitudinal slots, engaging a series of latch mating threads defined on an inner surface of the upper adapter with latching threads defined on each of the plurality of axially extending fingers, receiving a plurality of torque lugs provided by the torque collet into the plurality of longitudinal slots, each torque lug being defined on a corresponding plurality of axially-extending torque members, and applying a torsion load on the lower adapter from the upper adapter when the plurality of torque lugs are received in the plurality of longitudinal slots.

Each of embodiments A and B may have one or more of the following additional elements in any combination: Element 1: wherein the upper adapter is coupled to a drill string and the lower adapter is coupled to a casing running tool installed within a casing string, and wherein coupling the upper and lower adapters serves to couple the drill string to the casing string such that axial and torque loads from the drill string are conveyed to the casing string. Element 2: wherein the upper adapter further includes a seal assembly comprising one or more packing seals and the lower adapter further includes a seal bore configured to receive the one or more packing seals as the upper adapter is received into the lower adapter and thereby provide a sealed interface. Element 3: further comprising a radial protrusion defined on the upper adapter body, the radial protrusion exhibiting a diameter at least as large as the lower adapter body such that advancement of the upper adapter into the lower adapter ceases when the lower adapter body engages the radial protrusion. Element 4: wherein the latching collet includes a plurality of axially extending fingers, each axially extending finger having latching threads defined on an outer surface thereof, wherein the latching threads are configured to interact with the latch mating threads of the lower adapter, and a radial shoulder and a radial groove axially offset from the radial shoulder, wherein, when in a first configuration, the axially extending fingers are radially supported by the radial shoulder and, when in a second configuration, the axially extending fingers are radially offset from the radial groove. Element 5: wherein, when in the second configuration, the axially extending fingers are able to flex inwards such that the latching threads are able to ratchet against the latch mating threads as the upper adapter advances into the lower adapter. Element 6: wherein each axially extending torque member is supported at opposing ends and each is able to flex radially in a middle portion thereof. Element 7: wherein each torque lug has at least one beveled axial end configured to engage a beveled surface defined on an interior of the lower adapter body and thereby flex the axially extending torque members radially inward such that each torque lug is able to enter a corresponding one of the one or more longitudinal slots. Element 8: wherein the at least one beveled axial end is a lower axial end, and wherein each torque lug has a beveled upper axial end configured to engage the interior of the lower adapter body and thereby flex the axially extending torque members radially inward such that each torque lug is able to exit the corresponding one of the one or more longitudinal slots. Element 9: wherein the at least one angular direction is a first angular direction, and wherein each torque lug provides a beveled longitudinal edge that allows the torque collet to freely ratchet in a second angular direction opposite the first angular direction.

Element 10: wherein the latching collet further defines a radial shoulder and a radial groove axially offset from the radial shoulder, and the method further includes moving the axially extending fingers from being radially supported by the radial shoulder to being radially offset from the radial groove when the latching threads engage the series of latch mating threads, and ratcheting the latching threads against the latch mating threads as the upper adapter advances further into the lower adapter. Element 11: further comprising applying an axial tension load between the upper and lower adapters, and moving the axially extending fingers into radial engagement with the radial shoulder, and thereby preventing the latching threads against removal from the latch mating threads. Element 12: further comprising advancing the upper adapter into the lower adapter until an end of the lower adapter engages a radial protrusion defined on the upper adapter, and applying an axial compression load on the lower adapter from the upper adapter. Element 13: further comprising coupling the upper adapter to a drill string, coupling the lower adapter to a casing running tool secured to a casing string, and advancing the casing string into a wellbore with the drill string when the upper adapter is secured within the lower adapter. Element 14: further comprising conveying axial and torque loads from the drill string to the casing string through the upper and lower adapters. Element 15: wherein the upper adapter further includes a seal assembly comprising one or more packing seals and the lower adapter further includes a seal bore, the method further comprising receiving the seal assembly into the seal bore, and generating a sealed interface between the seal bore and the seal assembly with the one or more packing seals. Element 16: wherein each torque lug has at least one beveled axial end, the method further comprising engaging the at least one beveled axial end on a beveled surface defined on an interior of the lower adapter, and flexing the corresponding plurality of axially-extending torque members radially inward such that each torque lug is able to enter a corresponding one of the one or more longitudinal slots. Element 17: further comprising rotating the upper adapter with respect to the lower adapter until the plurality of torque lugs locate the plurality of longitudinal slots. Element 18: wherein each torque lug provides a beveled longitudinal edge and applying the torsion load on the lower adapter from the upper adapter further comprises rotating the upper adapter in a first angular direction and thereby rotating the lower adapter in the first angular direction, rotating the upper adapter in a second angular direction opposite the first angular direction, and ratcheting the upper adapter in the second angular direction without transmitting torque to the lower adapter as the beveled longitudinal edges of each torque lug engage longitudinal slats defined between the one or more longitudinal slots and thereby force the axially extending torque members out of engagement with the torque collet profile.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

What is claimed is:

1. A coupling assembly, comprising:

an upper adapter having an upper adapter body that provides a latching collet and a torque collet axially spaced from the latching collet, the torque collet including a plurality of axially-extending torque members and a corresponding torque lug provided on each axially-extending torque member; and a lower adapter having a lower adapter body configured to receive the upper adapter body and providing a series of latch mating threads defined on an inner surface of the lower adapter body for matingly engaging the latching collet, the lower adapter body further providing a torque collet profile that defines a plurality of longitudinal slots for receiving the torque lugs therein, wherein, when the upper adapter is received within the lower adapter, the upper adapter is able to apply compression and tension loads to the lower adapter, and wherein, when the torque lugs are received into the plurality of longitudinal slots, the upper adapter is able to apply torque to the lower adapter in at least one angular direction.

2. The coupling assembly of claim 1, wherein the upper adapter is coupled to a drill string and the lower adapter is coupled to a casing running tool installed within a casing string, and wherein coupling the upper and lower adapters serves to couple the drill string to the casing string such that axial and torque loads from the drill string are conveyed to the casing string.

3. The coupling assembly of claim 1, wherein the upper adapter further includes a seal assembly comprising one or more packing seals and the lower adapter further includes a seal bore configured to receive the one or more packing seals as the upper adapter is received into the lower adapter and thereby provide a sealed interface.

4. The coupling assembly of claim 1, further comprising a radial protrusion defined on the upper adapter body, the radial protrusion exhibiting a diameter at least as large as the lower adapter body such that advancement of the upper adapter into the lower adapter ceases when the lower adapter body engages the radial protrusion.

5. The coupling assembly of claim 1, wherein the latching collet comprises:

a plurality of axially extending fingers, each axially extending finger having latching threads defined on an outer surface thereof, wherein the latching threads are configured to interact with the latch mating threads of the lower adapter; and a radial shoulder and a radial groove axially offset from the radial shoulder, wherein, when in a first configuration, the axially extending fingers are radially supported by the radial shoulder and, when in a second configuration, the axially extending fingers are radially offset from the radial groove.

6. The coupling assembly of claim 5, wherein, when in the second configuration, the axially extending fingers are able to flex inwards such that the latching threads are able to ratchet against the latch mating threads as the upper adapter advances into the lower adapter.

7. The coupling assembly of claim 1, wherein each axially extending torque member is supported at opposing ends and each is able to flex radially in a middle portion thereof.

8. The coupling assembly of claim 7, wherein each torque lug has at least one beveled axial end configured to engage a beveled surface defined on an interior of the lower adapter body and thereby flex the axially extending torque members radially inward such that each torque lug is able to enter a corresponding one of the plurality of longitudinal slots.

9. The coupling assembly of claim 8, wherein the at least one beveled axial end is a lower axial end, and wherein each torque lug has a beveled upper axial end configured to engage the interior of the lower adapter body and thereby flex the axially extending torque members radially inward such that each torque lug is able to exit the corresponding one of the plurality of longitudinal slots.

10. The coupling assembly of claim 1, wherein the at least one angular direction is a first angular direction, and wherein each torque lug provides a beveled longitudinal edge that allows the torque collet to freely ratchet in a second angular direction opposite the first angular direction.

11. A method, comprising advancing an upper adapter at least partially into a lower adapter, the upper adapter having a latching collet providing a plurality of axially extending fingers and a torque collet axially spaced from the latching collet, and the lower adapter providing a torque collet profile that defines a plurality of longitudinal slots;

engaging a series of latch mating threads defined on an inner surface of the upper adapter with latching threads defined on each of the plurality of axially extending fingers;

receiving a plurality of torque lugs provided by the torque collet into the plurality of longitudinal slots, each torque lug being provided on a corresponding plurality of axially-extending torque members; and applying a torsion load on the lower adapter from the upper adapter when the plurality of torque lugs are received in the plurality of longitudinal slots.

12. The method of claim 11, wherein the latching collet further defines a radial shoulder and a radial groove axially offset from the radial shoulder, the method further comprising:

moving the axially extending fingers from being radially supported by the radial shoulder to being radially offset from the radial groove when the latching threads engage the series of latch mating threads; and ratcheting the latching threads against the latch mating threads as the upper adapter advances further into the lower adapter.

13. The method of claim 12, further comprising:

applying an axial tension load between the upper and lower adapters; and moving the axially extending fingers into radial engagement with the radial shoulder, and thereby preventing the latching threads against removal from the latch mating threads.

14. The method of claim 11, further comprising:

advancing the upper adapter into the lower adapter until an end of the lower adapter engages a radial protrusion defined on the upper adapter; and applying an axial compression load on the lower adapter from the upper adapter.

15. The method of claim 11, further comprising:

coupling the upper adapter to a drill string;

coupling the lower adapter to a casing running tool secured to a casing string; and advancing the casing string into a wellbore with the drill string when the upper adapter is secured within the lower adapter.

16. The method of claim 15, further comprising conveying axial and torque loads from the drill string to the casing string through the upper and lower adapters.

17. The method of claim 11, wherein the upper adapter further includes a seal assembly comprising one or more packing seals and the lower adapter further includes a seal bore, the method further comprising:

receiving the seal assembly into the seal bore; and generating a sealed interface between the seal bore and the seal assembly with the one or more packing seals.

18. The method of claim 11, wherein each torque lug has at least one beveled axial end, the method further comprising:

engaging the at least one beveled axial end on a beveled surface defined on an interior of the lower adapter; and flexing the corresponding plurality of axially-extending torque members radially inward such that each torque lug is able to enter a corresponding one of the one or more longitudinal slots.

19. The method of claim 11, further comprising rotating the upper adapter with respect to the lower adapter until the plurality of torque lugs locate the plurality of longitudinal slots.

20. The method assembly of claim 11, wherein each torque lug provides a beveled longitudinal edge and applying the torsion load on the lower adapter from the upper adapter further comprises:

rotating the upper adapter in a first angular direction and thereby rotating the lower adapter in the first angular direction;

rotating the upper adapter in a second angular direction opposite the first angular direction; and ratcheting the upper adapter in the second angular direction without transmitting torque to the lower adapter as the beveled longitudinal edges of each torque lug engage longitudinal slats defined between the one or more longitudinal slots and thereby force the axially extending torque members out of engagement with the torque collet profile.

* * * * *